US005229021A

United States Patent [19]

Pillon et al.

[11] Patent Number: 5,229,021

[45] Date of Patent: Jul. 20, 1993

[54] WAX ISOMERATE HAVING A REDUCED POUR POINT

[75] Inventors: Lillanna Z. Pillon, Sarnia; Andre E. Asselin, Forest, both of Canada

[73] Assignee: Exxon Research & Engineering Company, Florham Park, N.J.

[21] Appl. No.: 803,817

[22] Filed: Dec. 9, 1991

[51] Int. Cl.[5] ..... C10M 173/00

[52] U.S. Cl. ..... 252/56 R; 252/52 R

[58] Field of Search ..... 252/56 R, 52 R

[56] References Cited

U.S. PATENT DOCUMENTS

| | | | |
|---|---|---|---|
| 2,091,627 | 8/1937 | Bruson | 252/56 R |
| 3,607,749 | 9/1971 | Forbes | 252/56 R |
| 3,679,644 | 7/1972 | van der Meij et al. | 252/56 R |
| 3,764,537 | 10/1973 | Macleod | 252/56 R |
| 4,203,854 | 5/1980 | Silverstein | 252/25 |
| 4,844,829 | 7/1989 | Wilburn et al. | 252/56 R |
| 4,956,111 | 9/1990 | Wilburn et al. | 252/56 R |
| 4,968,444 | 11/1990 | Knoell et al. | 252/56 R |
| 5,149,452 | 9/1992 | MacAlpine et al. | 252/56 R |

OTHER PUBLICATIONS

Lubricant Additives, Smalheer C. V. et al., The Lezius-Miles Co., Cleveland, Ohio 1967.

*Primary Examiner*—Prince Willis, Jr.
*Assistant Examiner*—Jim Silbermann
*Attorney, Agent, or Firm*—John W. Ditsler; James H. Takemoto

[57] ABSTRACT

The addition of a polyalkylmethacrylate having a weight average molecular weight of at least 600,000 has been found to be effective in reducing the pour point of a wax isomerate to a level that cannot be obtained with conventional pour point depressants. In a preferred embodiment, the wax isomerate is a slack wax isomerate.

9 Claims, No Drawings

WAX ISOMERATE HAVING A REDUCED POUR POINT

BACKGROUND OF THE INVENTION

1. Field of the Invention

This invention concerns the use of a high molecular weight polyalkylmethacrylate to reduce the pour point of a wax isomerate.

2. Description of Related Art

The addition of polyalkylmethacrylates to lubricating oils is known. For example, U.S. Pat. No. 2,628,225 discloses that polyalkylmethacrylates can be used as VI improvers and pour point depressants in lubricating oils. In addition, U.S. Pat. No. 4,968,444 discloses that the pour point of a lubricating oil can be reduced by adding a mixture of acrylate or methacrylate polymers. Each polymer contains several acrylate or methacrylate esters. The molecular weight of both polymers ranges from 50,000 to 500,000. More recently, U.S. Ser. No. 630,466 discloses that the pour point of a wax isomerate can be reduced by using a combination of low and high molecular weight polyalkylmethacrylates.

However, these disclosures do not suggest reducing the pour point of a wax isomerate using the particular high molecular weight polyalkylmethacrylate described below.

SUMMARY OF THE INVENTION

This invention relates to a wax isomerate having a reduced pour point which comprises (a) a major amount of a wax isomerate, and (b) a minor amount of a polyalkylmethacrylate having a weight average molecular weight of at least 600,000, wherein the isomerate thus formed has a lower pour point than would have been obtained using a polyalkylmethacrylate having a weight average molecular weight below 600,000.

DETAILED DESCRIPTION OF THE INVENTION

This invention requires a wax isomerate and a high molecular weight polyalkylmethacrylate.

The wax isomerates used in this invention are the lubes fraction remaining following dewaxing the isomerate formed from isomerizing wax in the presence of a suitable catalyst under isomerization conditions.

The wax which is isomerized may originate from any number of sources. Synthetic waxes from Fischer-Tropsch processes may be used, as may be waxes recovered from the solvent or autorefrigerative dewaxing of conventional hydrocarbon oils, or mixtures of these waxes. Waxes from dewaxing conventional hydrocarbon oils are commonly called slack waxes and usually contain an appreciable amount of oil. The oil content of these slack waxes can range anywhere from 0 to 45% or more, but usually from 5 to 30% oil.

Isomerization is conducted over a catalyst containing a hydrogenating metal component—typically one from Group VI, or Group VIII, or mixtures thereof, preferably Group VIII, more preferably noble Group VIII, and most preferably platinum on a halogenated refractory metal oxide support. The catalyst typically contains from 0.1 to 5.0 wt. %, preferably 0.1 to 1.0 wt. %, and most preferably from 0.2 to 0.8 wt. % metal. The halogenated metal oxide support is typically an alumina (e.g. gamma or eta) containing chlorides (typically from 0.1 to 2 wt. %, preferably 0.5 to 1.5 wt. %) and fluorides (typically 0.1 to 10 wt. %, preferably 0.3 to 0.8 wt. %).

Isomerization is conducted under conditions of temperatures between about 270° to 400° C. (preferably between 300° to 360° C.), at pressures of from 500 to 3000 psi $H_2$ (preferably 1000–1500 psi $H_2$), at hydrogen gas rates of from 1000 to 10,000 SCF/bbl, and at a space velocity in the range of from 0.1 to 10 v/v/hr, preferably from 1 to 2 v/v/hr.

Following isomerization, the isomerate may undergo hydrogenation to stabilize the oil and remove residual aromatics. The resulting product may then be fractionated into a lubes cut and fuels cut, the lubes cut being identified as that fraction boiling in the 330° C.+ range, preferably the 370° C.+ range, or even higher. This lubes fraction is then dewaxed to reduce the pour point, typically to between about −15° to about −24° C. This fraction is the "wax isomerate" to which the high polyalkylmethacrylate of this invention is added. The polyalkylmethacrylate may also be added to a lubricating oil comprising a major amount of wax isomerate, a minor amount of the polyalkylmethacrylate, and a minor amount of a lubricating oil base stock (such as is described in U.S. Pat. No. 4,906,389, the disclosure of which is incorporated herein by reference).

The high molecular weight polyalkylmethacrylate should have a weight average molecular weight of at least about 600,000, preferably from 600,000 to about 1,000,000, as measured by gel permeation chromatography (GPC). The amount of high molecular weight polyalkylmethacrylate used can range from about 1 up to 20 wt. % or more. Practically, however, the amount of high molecular weight polyalkylmethacrylate will range from about 2 to about 10 wt. %, most preferably from about 3 to about 8 wt. %, based on weight of the final product.

The alkyl group comprising the high molecular weight polyalkylmethacrylate used in this invention may be straight chained or branched and should contain from 4 to 22 carbon atoms. Preferably, the polyalkylmethacrylate will contain $C_4$, $C_6$, $C_8$, $C_{10}$, $C_{12}$, $C_{14}$, $C_{18}$, and $C_{20}$ carbons. These polyalkylmethacrylates are known articles of commerce and, as such, are readily available in the marketplace. Frequently, the polyalkylmethacrylates are available from vendors in mixture with a solvent.

This invention will be better understood by reference to the following example, which includes a preferred embodiment of this invention.

EXAMPLE

Use of Low and High MW Polyalkylmethacrylates in Slack Wax Isomerate Basestock The pour point of several samples of a 10W40 formulation containing various polyalkylmethacrylates (PMA) was determined using ASTM D-97. The results of these tests are shown in Table 1 below:

TABLE 1

| Sample | A | B | C |
|---|---|---|---|
| Composition, wt. % | | | |
| SWI (1) | | 61.2 | |
| 600 Neutral | | 20.4 | |
| Other additives (2) | | 12.6 | |
| PMA, wt. % | | | |
| 500,000 (3) | 5.8 | — | — |
| 511,000 (4) | — | 5.8 | — |
| 600,000+ (5) | — | — | 5.8 |

TABLE 1-continued

| Sample | A | B | C |
|---|---|---|---|
| Pour Point, °C. | −30 | −33 | −42 |

(1) A slack wax isomerate having a viscosity of 29.4 cSt at 40° C., a viscosity index of 143, greater than 99.5% saturates, an initial boiling point of 341° C., a mid boiling point of 465° C., and a final boiling point of 570° C.

(2) Includes antifoaming agents, antioxidants, antiwear agents, detergents, dispersants, and friction modifiers.

(3) A commercially available VI improver available from Rohm and Haas as Ac 954.

(4) A commercially available VI improver available from Rohm and Haas as Ac 702.

(5) A commercially available VI improver available from Rohm and Haas as Ac 953.

The data in Table 1 show that the pour point of a slack wax isomerate can be reduced to −40° C. or lower (preferably −42° C. or lower) by using a single polyalkylmethacrylate provided it has a weight average molecular weight of at least 600,000.

What is claimed is:

1. An improved wax isomerate having a reduced pour point which comprises (a) a major amount of a wax isomerate having a pour point between about −15° C. to about −24° C., and (b) a minor amount of a polyalkylmethacrylate having a weight average molecular weight of at least 600,000, wherein the improved wax isomerate thus formed has a pour point of about −40° C. or lower.

2. The improved wax isomerate of claim 1 wherein the polyalkylmethacrylate has a weight average molecular weight ranging from 600,000 to about 1,000,000.

3. The improved wax isomerate of claim 1 wherein the alkyl group in the polyalkylmethacrylate has from 4 to 22 carbon atoms.

4. The improved wax isomerate of claim 1 which also contains a minor amount of a lubricating oil base stock.

5. An improved slack wax isomerate having a reduced pour point which comprises (a) a major amount of a slack wax isomerate having a pour point between about −15° C. to about −24° C., and (b) from about 1 to about 20 weight % of a polyalkylmethacrylate having a weight average molecular weight of at least 600,000, wherein the improved slack wax isomerate thus formed has a pour point of about −40° C. or lower.

6. The improved slack wax isomerate of claim 5 wherein the amount of polyalkylmethacrylate ranges from 2 to about 10 wt. %.

7. The improved slack wax isomerate of claim 6 wherein the polyalkylmethacrylate has a weight average molecular weight ranging from 600,000 to about 1,000,000.

8. The improved slack wax isomerate of claim 5 wherein the polyalkylmethacrylate contains $C_4$, $C_6$, $C_8$, $C_{10}$, $C_{12}$, $C_{14}$, $C_{16}$, $C_{18}$, and $C_{20}$ carbons.

9. A lubricating oil containing a major amount of the improved slack wax isomerate of claim 5 and a minor amount of a lubricating oil base stock.

* * * * *